US008104641B2

(12) United States Patent
Gehman

(10) Patent No.: US 8,104,641 B2
(45) Date of Patent: Jan. 31, 2012

(54) FLUID DISPENSING APPARATUS AND METHOD

(75) Inventor: Michael Chad Gehman, Barto, PA (US)

(73) Assignee: Dresser, Inc., Addison, TX (US)

( * ) Notice: Subject to any disclaimer, the term of this patent is extended or adjusted under 35 U.S.C. 154(b) by 480 days.

(21) Appl. No.: 12/418,070

(22) Filed: Apr. 3, 2009

(65) Prior Publication Data

US 2010/0252571 A1 Oct. 7, 2010

(51) Int. Cl.
*B67D 7/12* (2010.01)

(52) U.S. Cl. ..... 222/74; 222/1; 222/75; 222/146.2; 222/529; 222/530; 222/538

(58) Field of Classification Search ..... 222/1, 2, 222/52, 74–75, 71, 173, 146.2, 153.14, 529–530, 222/533, 538, 372, 383.1, 383.2; 137/355.16, 137/355.17, 355.19, 355.26, 355.2
See application file for complete search history.

(56) References Cited

U.S. PATENT DOCUMENTS

| | | | | |
|---|---|---|---|---|
| 1,893,972 | A | 1/1933 | Whitman | |
| 2,150,025 | A | 3/1939 | Cook, Jr. et al. | |
| 3,487,850 | A | 1/1970 | Wahler et al. | |
| 4,557,436 | A | 12/1985 | Drake | |
| 5,083,846 | A * | 1/1992 | Day et al. | 312/321.5 |
| 5,867,403 | A * | 2/1999 | Sasnett et al. | 700/282 |
| 6,328,060 | B1 | 12/2001 | Smith | |
| 6,334,457 | B1 | 1/2002 | Baker, IV | |
| 7,254,463 | B1 * | 8/2007 | Moore | 700/241 |
| 2011/0089190 | A1 * | 4/2011 | Gehman | 222/1 |

FOREIGN PATENT DOCUMENTS

| | | | |
|---|---|---|---|
| DE | 8708333 | | 6/1987 |
| DE | 202007012316 | U1 | 12/2007 |
| EP | 1113979 | | 6/2002 |
| EP | 1243549 | A | 9/2002 |
| EP | 1331200 | A1 | 7/2003 |
| EP | 1398294 | A1 | 3/2004 |
| EP | 1845057 | | 8/2008 |
| WO | WO 00/61490 | A1 | 10/2000 |

OTHER PUBLICATIONS

Tokheim, "Quantium T series AdBlue—Dispensing Success the World Over" (4 pages); Feb. 24, 2005.
Gilbarco Veeder-Root, "SK700 AdBlue—The Smart AdBlue Fuelling Station," copyright 2006 (2 pages). Dresser Wayne Pignone, "AdBlue® fuel dispensers: New technology for an emerging market" (2 pages); Sep. 5, 2006.
European Search Report for EP 06112475.6 dated Nov. 24, 2006, 6 pages.
International Search Report and Written Opinion for PCT/US2010/049269 dated Dec. 30, 2010, 9 pages.

* cited by examiner

*Primary Examiner* — Frederick C. Nicolas
(74) *Attorney, Agent, or Firm* — Woodcock Washburn LLP

(57) ABSTRACT

A fluid dispenser hose module includes a housing adapted to enclose the fluid nozzle and at least a portion of a fluid hose within an interior volume of the housing. A first door located adjacent an exterior of the housing allows removal of the fluid nozzle when the first door is adjusted from a closed position to an open position. The first door automatically returns to the closed position from the open position when the fluid nozzle is returned to the boot. A second door adjacent the exterior of the housing automatically adjusts from a shut position to a retracted position when the first door is adjusted from the closed position to the open position. The second door allows access to the fluid hose in the retracted position and automatically returns to the shut position from the retracted position when the first door returns to the closed position.

23 Claims, 6 Drawing Sheets

FLUID DISPENSING APPARATUS AND METHOD

TECHNICAL FIELD

This disclosure relates to fluid dispensing and, more particularly, to fluid dispensing at a fueling environment by a fluid dispenser with multiple self-closing doors.

BACKGROUND

Fueling environments, such as commercial or fleet fueling stations, convenience stores, retail fueling stations, and large consumer retailers, typically include one or multiple fluid dispensers. Such fluid dispensers are most often fuel dispensers, operated by the consumer to dispense fuel (e.g., gasoline, biofuels, diesel) into a variety of vehicles. The exemplary fueling environments, however, often include other types of fluid dispensers that consumers require to maintain their vehicles. For example, fueling environments often include dispensers for water and air in order for consumers to maintain the coolant and tire systems, respectively, on their vehicles. In certain types of vehicles, such as vehicles designed to operate on diesel fuel or biodiesel additional fluids may be required to properly operate and maintain the vehicles. For example, a diesel-powered vehicle may typically require additional fluids to provide for acceptable and lawful operation of an emissions system of the vehicles.

Selective Catalytic Reduction (SCR) is an emissions system typically used in diesel vehicles to reduce $NO_x$ emissions. In an SCR system, aqueous urea may be sprayed directly into the vehicle exhaust stream, creating ammonia gas. Through a catalytic converter, the ammonia combines with the $NO_x$ gasses to convert such gases into nitrogen and water. This emissions solution has been employed in Europe for several years, where the aqueous urea solution is often referred to as "AdBlue." In some instances, use of SCR systems may be dictated by regulatory requirements, such as government emission standards designed, to limit an amount of emissions acceptably expelled from a diesel vehicle.

SCR systems in the United States typically employ Diesel Exhaust Fluid (DEF), which, is often used as a generic name for the aqueous urea solution. In some vehicles, such as, for example, diesel trucks, a separate DEF storage tank may be maintained on the truck and must be refilled regularly. For a variety of reasons, including convenience, fueling environments may include both fuel dispensers and DEF dispensers on the premises. DEF dispensers are often designed to account for the chemical characteristics of the aqueous urea solution (DEF). Further, since DEF is typically a 32.5% solution of chemically pure, urea in deionized water, its freezing point is approximately 12° F. (−11° C.). Various components of the DEF dispenser may therefore be more easily susceptible to damage from freezing conditions.

Several solutions to the challenge of maintaining DEF dispensers in environmentally-challenging climates have been employed. For instance, some solutions include merely enclosing the DEF dispenser components in a housing with a simple hinged door allowing access to such components. Such solutions, however, often suffer from, several disadvantages, including the possibility of significant abuse and damage to the door in fueling environments. Further, there is no assurance the door will be closed after use, negating any climate-control affects of the DEF dispenser housing. Another solution includes the use of electrically-operated automatic doors allowing access to the components of the DEF dispenser. While such doors may solve the problem of accidental non-closure, they often, have operational problems in fueling environments that are often abusive to equipment. Yet another solution includes completely enclosing the DEF dispenser components within an enclosure, allowing only certain components, for example a dispensing nozzle and hose, to be removed from the enclosure. Such a solution often requires constant tension to be placed on the hose, urging it back into the enclosure. Thus, a fueling consumer must always wrestle with the hose under tension and there could be problems drawing hose accessories, for instance a breakaway, into the cabinet. Another solution includes a dispenser housing with multiple openings, allowing access to the nozzle and hose, respectively. The hose opening, however, is usually protected by interlocking brushes, which may help keep heat within the enclosure while allowing the hose to pass through the opening. Such a design, however, does not totally seal the enclosure against the loss of thermal energy to the environment. Further, the brushes often hamper a user as she attempts to extend the hose from, the cabinet.

SUMMARY

In one general implementation, a fluid dispenser includes a control module and a hose module. The control module is operable to receive at least one command to dispense a fluid and, in response to the command, dispense fluid through a fluid nozzle. The hose module includes a housing adapted to enclose the fluid nozzle and at least a portion of a fluid hose within an interior volume of the housing, where the fluid nozzle is supported in a boot when enclosed within the housing. The hose module also includes a first door located adjacent an exterior of the housing and allowing removal of the fluid nozzle from the boot through a first opening created when the first door is adjusted from a closed position to an open position. The first door automatically returns to the closed position from the open, position when the fluid nozzle is returned to the hoot. The hose module further includes a second door adjacent the exterior of the housing and automatically adjusted from a shut position to a retracted position when the first door is adjusted from the closed position to the open position. The second door allows access to the fluid hose in the retracted position and automatically returns to the shut position from the retracted position when the first door returns to the closed position.

In some specific embodiments of the general implementation, the hose module may further include a third door adjacent the exterior of the housing and adjacent, the second door, where the third door automatically may be adjusted from a shut position to a retracted position when the first door is adjusted from the closed position to the open, position. The third door may allow access to the fluid hose in the retracted position and automatically return to the shut position from the retracted position when the first door returns to the closed position. Additionally, at least one of the first, second, and third doors may include a portion of the exterior of the housing. Further, the fluid dispenser may include at least one heater mounted within the interior volume of the housing or to the exterior of the housing, where the heater may be adapted to provide thermal energy to the interior volume of the housing.

In certain embodiments, the fluid hose may include a first segment of fluid hose, where at least a portion of the first segment may be freely extendable from a rest position within the interior volume of the housing when the second door is in the retracted position. The fluid hose may experience substantially no tensile force urging the fluid hose to the rest position when the portion of the first segment is extended from the inferior volume of the housing. The fluid hose may further include a second segment of fluid hose coupled to the first segment, where at least a portion of the second segment may be extendable from the rest position when the second door is in the retracted position. The fluid hose may experience a tensile force urging the fluid hose to the rest position when the portion of the second segment is extended from the rest position. In some aspects, the tensile force may automatically retract the second segment of the fluid hose to the rest position when the fluid nozzle is enclosed within the housing.

In certain embodiments, the hose module may further comprise a ballast enclosed within the housing and coupled to the first door, with the first door having greater weight than the ballast. Further, the first door may include a plunger and the hose module may further include a linkage coupled to the second door. The linkage may include a spring having a corresponding spring force urging the second door to the retracted position from the shut position. The plunger may be adapted to exert a force on the linkage greater than the spring force as the first door returns to the closed position from the open position. The second door may be urged from the retracted position to the shut position as the plunger exerts the force on the linkage. In specific embodiments, the fluid hose may be adapted to carry an aqueous urea solution.

In another general implementation, a fluid dispenser hose module includes a housing adapted to enclose the fluid nozzle and at least a portion of a fluid hose within an interior volume of the housing, where the fluid nozzle is supported in a boot when enclosed within the housing. The hose module also includes a first door located adjacent an exterior of the housing and allowing removal of the fluid nozzle from the boot through a first opening created when the first door is adjusted from a closed position to an open position. The first door automatically returns to the closed position from the open position when the fluid nozzle is returned to the boot. The hose module further includes a second door adjacent the exterior of the housing and automatically adjusted from a shut position to a retracted position when the first door is adjusted from the closed position, to the open position. The second door allows access to the fluid hose in the retracted position and automatically returns to the shut position from the retracted position when the first door returns to the closed position.

In some specific embodiments, the hose module may include a third door adjacent the exterior of the housing and adjacent the second door, where the third door may automatically be adjusted from a shut position to a retracted position when the first door is adjusted from the closed position to the open position. The third door may allow removal of at least a portion of the fluid hose through a third opening adjacent the second opening when the third door is adjusted to the retracted position and may automatically return to the shut position from the retracted position when the first door returns to the closed position. In some embodiments, the second door and the third door may be automatically adjusted from their corresponding shut positions to their corresponding retracted positions substantially simultaneously when the first door is adjusted from the closed position to the open position, and further may be automatically adjusted from their corresponding retracted positions to their corresponding shut positions substantially simultaneously when the first door returns to the closed position.

The hose module may also include at least one heater mounted within the interior volume of the housing or to the exterior of the housing, where the heater is adapted to provide thermal energy to the interior volume of the housing. The fluid hose may include a first segment of fluid hose, at least a portion of which may be freely extendable from a rest position within the interior volume of the housing when the second door is in the refracted position. The fluid hose may experience substantially no tensile force urging the fluid hose to the rest position when the portion of the first segment is extended from the interior volume of the housing. The fluid hose may further include, a second segment of fluid hose coupled to the first segment, where at least a portion of the second segment may be extendable from the rest position when the second door is in the retracted position. The fluid hose may experience a tensile force urging the fluid hose to the rest position when the portion of the second segment is extended from the rest position. The tensile force may automatically retract the second segment of the fluid hose to the rest position when the fluid nozzle is enclosed within the housing.

The hose module may further include a ballast enclosed within the housing and coupled to the first door. The ballast may exert a ballast force on the first door corresponding to a weight of the ballast, with the first door having greater weight than the ballast. The hose module may also include a plunge pin adapted to exert a force on at least one of the first door and the ballast when the fluid nozzle is removed from the boot, where a sum of the force and the ballast force may be greater than the weight of the first door. The hose module may further include a blocking member adapted to prevent the first door from returning to the closed position from the open, position when the fluid nozzle is removed from the boot and allow the first door to return to the closed position from the open position upon return of the fluid nozzle to the boot.

In certain embodiments, the first door may include a plunger and the hose module may further include a linkage coupled to the second door. The linkage may include a spring having a corresponding spring force urging the second door to the retracted position from the shut position. The plunger may be adapted to exert a force on the linkage greater than the spring force as the first door returns to the closed position from the open position and the second door may be urged from the retracted position to the shut position as the plunger exerts the force on the linkage. The fluid hose, in some aspects, may be adapted to carry an aqueous urea solution.

In another general implementation, a method for dispensing fluid includes providing a fluid dispenser that includes a control module and a hose module. The hose module includes a housing adapted to enclose the fluid nozzle supported in a boot when enclosed within the housing and at least a portion of a fluid hose within an interior volume of the housing; a first door located adjacent an exterior of the housing that automatically returns to the closed position from the open position when the fluid nozzle is returned to the boot; and a second door located adjacent the exterior of the housing and automatically adjusted from a shut position to a retracted position when the first door is adjusted from the closed position to the open position. The second door allows access to the fluid hose in the retracted position and automatically returns to the shut position from the retracted position when the first door returns to the closed position. The method further includes receiving a command at the control module to commence fluid dispensing; adjusting the first door from the closed position to the open position to create an opening allowing access to the fluid nozzle within the interior volume of the housing; removing the fluid nozzle from the boot through the opening; dispensing fluid from the fluid nozzle; and returning the fluid nozzle to the boot.

Various embodiments of a fluid dispenser utilizing a hose module according to the present disclosure may have one or more of the following features. For example, the fluid dispenser may include one or more self-closing doors to effectively enclose the dispenser components in a climate-controlled housing. The fluid dispenser may permit sealing an entire nozzle and hose assembly for environmental conditioning. The fluid dispenser may include one or more doors able to be stored in a retracted interior position for times of the year and climates when environmental conditioning may not be required or desirable. Further, the fluid dispenser may include an initial length of substantially tension-free hose that may be removed and returned freely within the fluid dispenser enclosure. The fluid dispenser may also include an additional portion of hose available under tension for longer hose access from the fluid dispenser.

Various embodiments of the fluid dispenser utilizing the hose module according to the present disclosure may also have one or more of the following features. For example, the fluid dispenser may utilize a simpler and more reliable design that is able to withstand abusive fueling environments. Further, the fluid dispenser may be applicable to both domestic and foreign jurisdictions with little to no modification. The fluid dispenser may also be applicable for a variety of fluids where climate control is a concern, such as an aqueous urea solution (DEF or AdBlue), biodiesel, or other organic fuel. The fluid dispenser may also include a sealed or substantially sealed housing for the components of the dispenser. As another example, the fluid dispenser may include multiple doors mechanically coupled such that all of the doors may be opened to allow access to the dispenser components through the opening of a single door. The fluid dispenser may also include automatically closing doors such that each door shuts to environmentally seal the dispenser after use of the dispenser.

These general and specific aspects may be implemented using a device, system, or method, or any combinations of devices, systems, or methods. The details of one or more embodiments are set forth in the accompanying drawings and the description below. Other features will be apparent from the description and drawings, and from the claims.

DESCRIPTION OF DRAWINGS

Like reference symbols in the various drawings indicate like elements.

DETAILED DESCRIPTION

A fluid dispenser according to the present disclosure includes a hose module to more effectively and efficiently manage and protect one or more components for fluid dispensing. The fluid dispenser, in some embodiments, may be utilized to dispense an aqueous urea solution, such as DEF or AdBlue, into a diesel vehicle or storage tank. The dispenser, however, may generally be used to dispense any fluid, particular fluids that may be adversely affected by atmospheric conditions (e.g., heat, cold, humidity), which may be encountered in the environment within which they are installed. The hose module includes a housing to enclose a nozzle, a fluid hose, and other various components of the fluid dispenser. A nozzle door is mounted substantially flush with the exterior of the housing and may be opened to allow access to the nozzle. By opening the nozzle door to allow access to the nozzle, one or more hose doors automatically open to allow the fluid hose to be freely extended from the hose module. The nozzle door and hose door are automatically held open during a fluid dispensing operation without intervention on the part of the customer or user of the fluid dispenser other than removing the nozzle from its stored position. Upon completion of a fluid dispensing operation and return of the nozzle back into its stored position, the nozzle door automatically closes, thereby also closing the nose door and effectively sealing the hose module against the outdoor environment.

Figure 1:
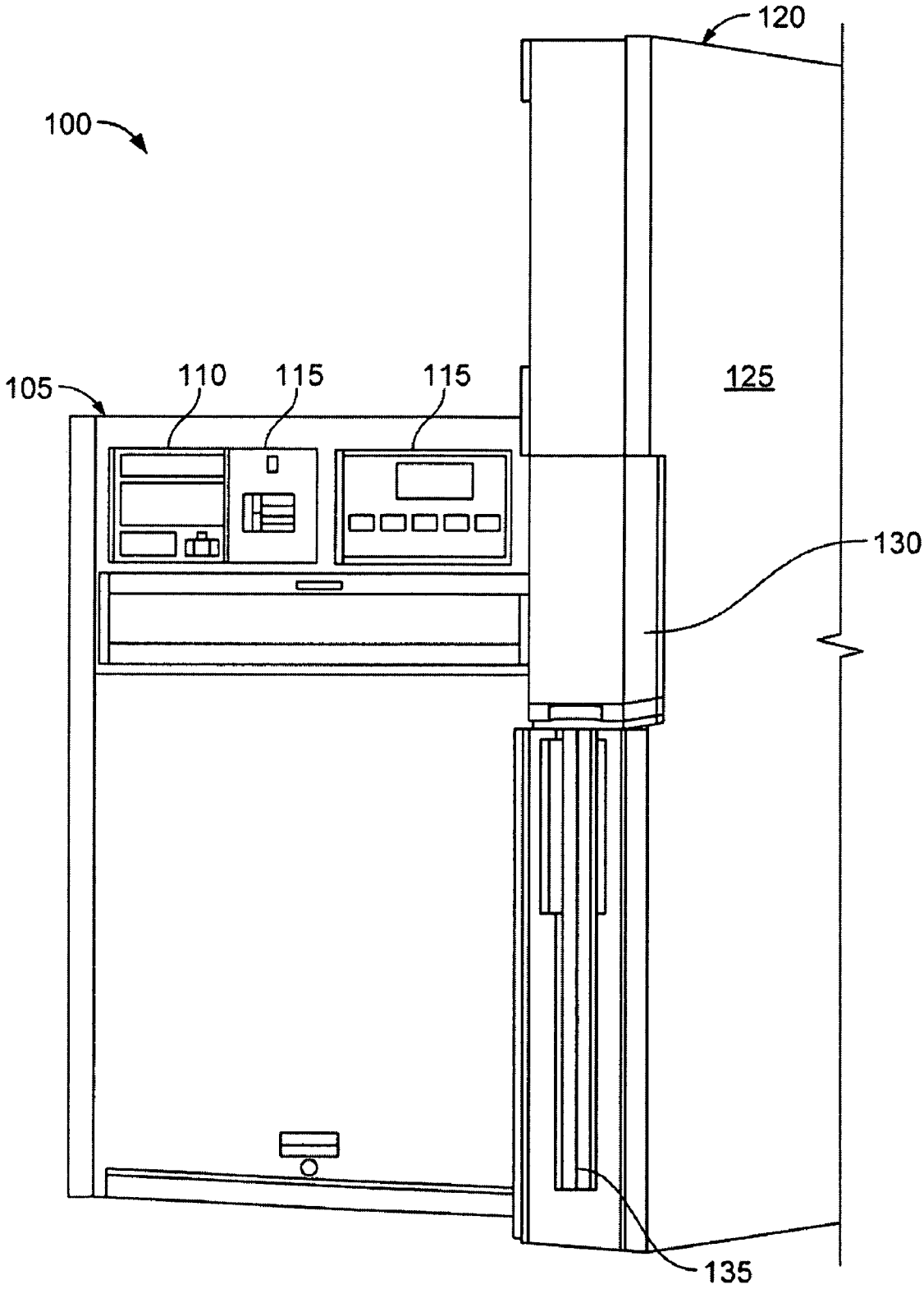
FIG. 1 illustrates one embodiment of a fluid dispenser including a hose module according to the present disclosure.

FIG. 1 illustrates a fluid dispenser 100 including a hose module 120. Generally, the fluid dispenser 100 facilitates one or more fluid dispensing transactions and operations. The fluid, dispenser 100 may be located at any appropriate fueling facility (not shown), such as a gas station environment, a convenience store environment, "big box" consumer store, fleet fueling facility, or corporate fueling facility. In addition, the fluid dispenser 100 may be located and utilized apart from a fueling facility, such as at a DEF or AdBlue dispensing facility. Fluid dispenser 100, in some embodiments, controls, facilitates, or otherwise manages the dispensing of an aqueous urea solution used in diesel-powered vehicles, such as DEF or AdBlue. In some embodiments, however, fluid dispenser 100 may be utilized to dispense any other appropriate fluid that may be climate-controlled or otherwise environmentally protected, such as biodiesel or other organic fuel. For example, fluid dispenser 100 may be utilized to dispense fluids having a freezing- or gel-point greater than 0° F. (−18° C.).

Fluid dispenser 100 may typically operate in cooperation with one or more additional fluid dispensers at the fueling facility. In doing so, fluid dispenser 100 may recognize when a customer is present (e.g., by detecting activation of an input device or removal of a nozzle) and notify the fueling facility, which may then obtain payment information from the customer, authenticate the customer, and allow fluid dispensing to begin. The fluid dispenser 100 may also communicate the dispensed amount of fluid to a fueling facility controller, which, may complete the sales transaction when the customer is finished dispensing the fluid. The fluid dispensers may, however, operate independently of the facility controller and/or a store interface unit for certain tasks and/or periods of time, when appropriate.

Fluid dispenser 100 may communicate with the fueling facility through a variety of techniques. For instance, communication may be by wireline (e.g., IEEE 802.3 or RS-232), wireless (e.g., IEEE 802.11, CDMA 2000, or GPRS), or optical (e.g., FDDI or SONET). A communication network facilitating such communication may include one or more components, such as hubs, routers, switches, bridges, repeaters, multiplexers, and transceivers. In particular embodiments, the communication network may operate by a combination of communication techniques. As such, the communication network may be coupled to fluid dispenser 100, one or more additional fluid dispensers, one or more fuel dispensers, and the fueling facility by communication links including wireline (e.g., twisted pair wire or coaxial cable), wireless (e.g., radio frequency (RF) or infrared (IR)), optical (e.g., fiber-optic cable), and/or any other appropriate path for conveying information. In particular embodiments, the communication links may include a combination of communication link types (e.g., wireline and wireless).

Fluid dispenser 100 includes a control module 105, a controller 110, one or more user devices 115, and the hose module 120. Generally, control module 105 and hose module 120 consist of separate enclosures connected together to form an integral fluid dispenser 100. In some embodiments, however, the control module 105 and hose module 120 may be standalone modules communicably coupled, or, in some aspects, the modules 105 and 120 may be formed as a single enclosure. In any event, the control module 105 and the hose module 120 function together to allow fluid dispensing from the fluid dispenser 100. Thus, the present disclosure contemplates that one or more components or portions of the control module 105 and the hose module 120 may be manufactured, tested, sold, or installed separate from each other.

In some embodiments, one or more portions of the fluid dispenser 100 may be incorporated into, integrated with, or otherwise coupled to a fuel dispenser at the fueling facility, such as a diesel fuel dispenser. For instance, the hose module 120 may be incorporated into a diesel fuel dispenser at the fueling facility as an additional module to the fuel dispenser. Thus, customers may dispense both diesel fuel and, for example, DEF fluid from a single dispenser. In some embodiments of the combined fuel and fluid dispenser, the fuel hose and nozzle may not need additional environmental protection while the fluid hose and nozzle may need such protection, such as, for example, one or more of the nozzle door 130 and the hose doors 135, described more fully below.

In some embodiments, an exterior shell of the control module 105 and/or the hose module 120 may be formed of corrosion resistant material, such as aluminum, stainless steel, or other appropriate material. For instance, in some embodiments of the fluid dispenser 100 used to dispense DEF, a housing 125 of the hose module 120 and one or more components of the hose module 120 (described below with reference to FIG. 2) may be formed of anodized aluminum due to, for instance, the chemical properties of DEF. Further, in some aspects, some or all of the housing 125 may be insulated.

The control module 105 controls the dispensing of fluid from fluid dispenser 100. To accomplish this, control module 105 may control the hydraulic elements of the dispenser 100 necessary to carry out fluid dispensing operations. For example, control module 105 may control submersible pumps in fluid storage tanks and fluid control valves and monitor fluid flow information via metering and reporting sub-systems. Control module 105 may also track the volume of fluid dispensed totals by type, drive sale progress displays on the sales/volume displays, and monitor for errors.

Controller 110, generally, is responsible for managing the operations of fluid dispenser 100 and may be located in any appropriate location within or integral with the control module 105. To accomplish this, the controller 110 may control the electronic functions of fluid dispenser 100. The controller 110 may also collect and maintain status information regarding the fluid dispenser 100 and report the status information to the fueling facility. Controller 110 may be implemented, in software, hardware, or a combination thereof. For example, the controller 110 may store in memory and execute one or more software applications written or described in any appropriate computer language including C, C++, Java, Visual Basic, assembler, Perl, any suitable version of 4GL, as well as others. Such applications may be executed by one or more processors located within or communicably coupled to the controller 110. Such processors execute instructions ad manipulate data to perform the operations of the controller 110. Each processor may be, for example, a central processing unit (CPU), a blade, as application specific integrated circuit (ASIC), or a field-programmable gate array (FPGA). Although the present disclosure contemplates a single processor in controller 110, multiple processors may be used according to particular needs and reference to a single processor is meant to include multiple processors where applicable.

Controller 110 may further include one or more memory devices located therein or communicably coupled to the controller 110. In some embodiments, for example, such memory may be any database module and may take the form of volatile or non-volatile memory including, without limitation, magnetic media, optical media, random access memory (RAM), read-only memory (ROM), removable media, or any other suitable local or remote memory component. The memory may also include any other appropriate data such as print or other reporting files. HTML files or templates, data classes or object interfaces, and software sub-applications or sub-systems.

User devices 115 may be installed within the control module 105 or communicably coupled to the control module 105 and, typically, allow a customer or user to interact (e.g., receive information and requests for information, provide responses to requests for information, provide transaction data, such as payment data or identification data) with the fluid dispenser 100 prior to, during, and subsequent to fluid dispensing transactions. Generally, each of the user devices 115 is communicably coupled to the controller 110 and exchanges data with the controller 110. Although illustrated as two user devices 115, fewer or more user devices may be provided with the fluid dispenser 100, as appropriate Each user device 115 may be one or more interactive components. For instance, the user device 115 may be a keypad, a keyboard, a touchpad, a touch screen, a card reader, or any other appropriate device for allowing a user to provide an indication to the fuel dispenser. User device 115 may also be a customer display and allow a customer of the fluid dispenser 100 to receive visual or auditory data originating from the fluid dispenser 100, fueling facility, or third party location (e.g., payment card issuer). As a display, the user device 115 may be a cathode ray tube (CRT) monitor, a liquid crystal display (LCD) monitor, a gas-plasma monitor, or any other appropriate device for visually presenting information. In some embodiments, user devices 115 may work in concert with each other (e.g., the display may present, instructions or data for the keyboard, keypad, or card reader and/or input from the keypad or card reader may correlate with data presented on the display).

The hose module 120, typically, encloses one or more components operable to dispense fluid upon initiation of a fluid dispensing transaction. Such, components include, for instance, a nozzle and a fluid hose among other components (described below). At least a portion of the components of the hose module 120 may be enclosed within the housing 125. In some embodiments, the housing 125 may include an aperture within a bottom or side surface of the hose module 120. The aperture may allow access for connecting the fluid hose to the hydraulic dispensing equipment (e.g., pumps, valves, meters) located underground or otherwise remote from the fluid dispenser 100.

Hose module 120 also includes a nozzle door 130. The nozzle door 130, typically, provides an access location for the user of the fluid dispenser 100 to gain access to the nozzle of the dispenser 100. The nozzle door 130 may also at least partially seal the hose module 120 against the exterior environment (e.g., rain, snow, heat). As explained more fully with respect to FIGS. 2 and 3A-B, nozzle door 130 may be vertically operated (e.g., moved up and/or down) such that the door 130 remains open or partially open for removal of the nozzle from the hose module 120 and during a fluid dispensing operation and automatically closes upon completion of the dispensing operation when the nozzle is returned to its stored position. Alternatively, in some embodiments, the nozzle door 130 may be horizontally operated (e.g., moved side-to-side) to open and/or close. Further, in some embodiments, the nozzle door 130 may be hinged and rotatably adjusted to open and/or close.

Hose module 120 also includes one or more hose doors 135. The hose doors 135, typically, provide a scalable opening into the housing 125 of the hose module 120 and allow the hose enclosed therein to be removed from the housing 125. For instance, as explained more fully with respect to FIGS. 2, 3A-B, and 4A-B, the hose doors 135 may be opened during the dispensing operation and automatically close upon closure of the nozzle door 130. Further, in some embodiments, the hose doors 135 and/or the nozzle door 130 may be kept open (e.g., locked or latched) during periods of milder climates, such as, for example, when outside temperatures are well above the freezing- or gel-point of the fluid to be dispensed by the dispenser 100.

Figure 2:
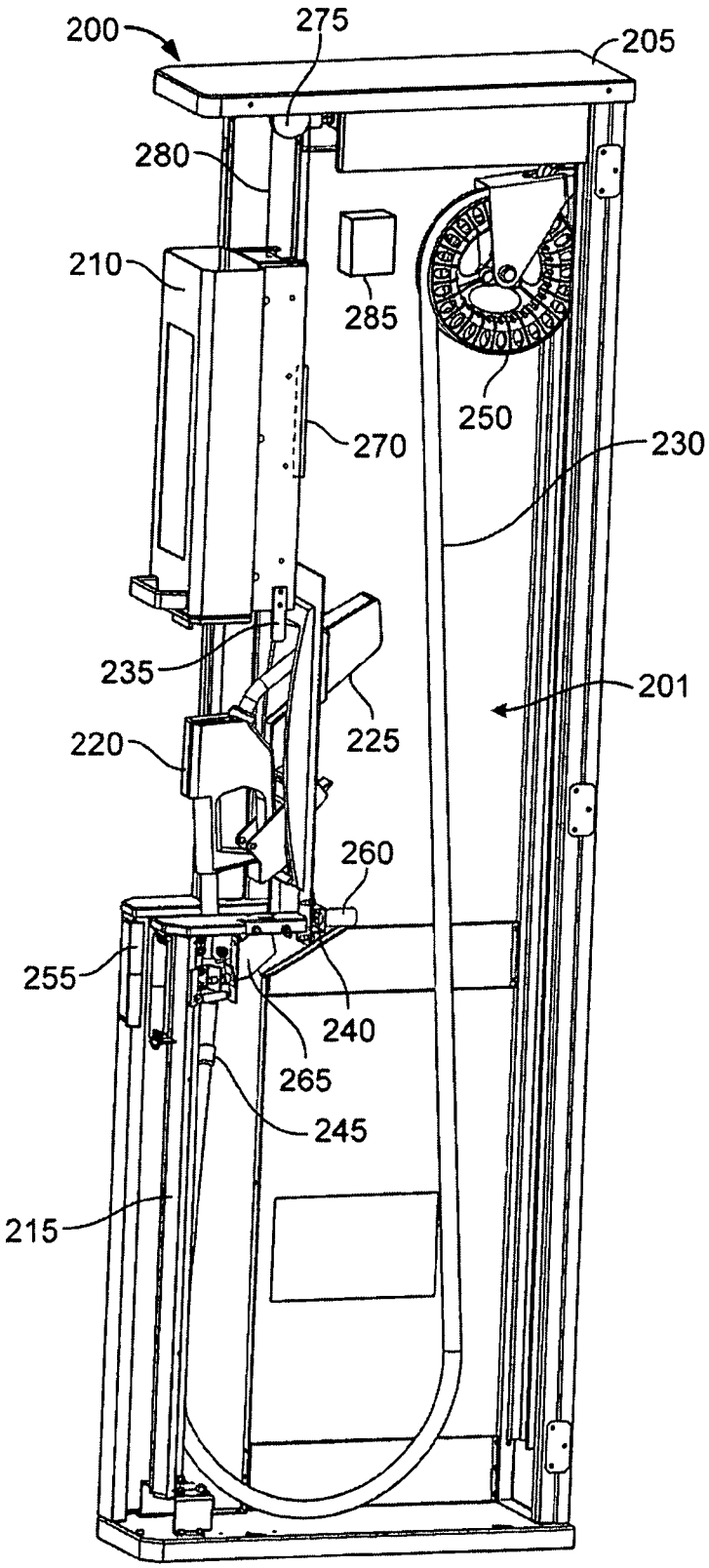
FIG. 2 illustrates a sectional view of one embodiment of a hose module according to the present disclosure.

FIG. 2 illustrates a sectional view of one embodiment of a hose module 200. In some embodiments, hose module 200 may be similar or substantially similar to the hose module 120 of the fluid dispenser 100 shown in FIG. 1. Hose module 200 includes a housing 205, a nozzle door 210 including a plunger 235, one or more hose doors 215, a nozzle 220, a nozzle boot 225, and a fluid hose 230 including a breakaway, or coupling 245. The fluid hose 230 may also include a swivel (not shown), which may be coupled to the nozzle 220 and allow for single or dual-plane rotation of the nozzle 220 to make handling of the nozzle 220 easier for the user. The hose module 200 also includes a hose pulley 250, a linear solenoid 260 with a plunge pin 240, one or more rollers 255, one or more linkages 265, a ballast 270 coupled to a ballast cord 280 over a ballast pulley 275, and an air conditioner 285. In some embodiments, the ballast 270, ballast cord 280, and ballast pulley 275 may be replaced with a spring-loaded reel to serve the same function as the ballast 270, In some embodiments, the housing 205, nozzle door 210, and hose doors 215 may be the same or similar to the corresponding components of hose module 120.

As shown in FIG. 2, nozzle door 210 includes a handle and, typically, is slideable vertically along one or more tracks or slots (not shown) integral to the housing 205. Generally the nozzle door 210 may be adjusted upward from a closed position, in which the door 210 substantially encloses the nozzle 220 within the housing 205, to an open position, illustrated in FIG. 2. Thus, in the open position, the nozzle door 210 may allow access for the customer or user to grasp the nozzle 220 and remove if from the nozzle boot 225. One or more plungers 235 are fastened to the nozzle door 210 and, typically, protrude downward from a bottom edge of the door 210. In some embodiments, one or more plungers 235 are located on either side of the nozzle door 210. As explained more tally below, the plungers 235 disengage the linkages 265 to automatically open the hose doors 215 when the nozzle door 210 is adjusted upward to its open position. The plungers 235 also engage the linkages 265 to automatically close the hose doors 215 when the nozzle door 210 is adjusted downward to its closed position.

The hose doors 215, typically, are pivotable into the interior volume 201 to a retracted position thus allowing access to the fluid hose 230. For instance, each hose door 215 may engage a rotatable pin structure at the top and/or bottom of the door 215, thus allowing the door 215 to swing open when the nozzle door 210 is adjusted to the open position. As the hose doors 215 are typically opened automatically when the nozzle door 210 is opened, the hose doors 215 may not include any handles or graspable protrusions in some embodiments, thus providing a surface that may be slightly recessed, in some aspects, the slightly recessed surface of the hose doors 215 may allow for decreased damage to the hose module 200 in a fueling environment.

One or more rollers 255 may be located adjacent each hose door 215 and located on the exterior of the housing 205. The rollers 255, typically, may be substantially cylindrical in shape and freely rotatable. In some embodiments, the rollers 255 may extend the entire height of the hose doors 215, or alternatively may extend only a portion of the height of the doors 215. The rollers 255 also may allow the customer or user to more easily manage and extend the fluid hose 230 from the housing 205 at a variety of positions and angles.

The nozzle 220 is in fluid communication with the fluid hose 230 and, typically, allows the consumer or user to dispense fluid into a vehicle, storage container, or other appropriate location while controlling a volumetric flow rate of the dispensed fluid. When not in use, the nozzle 220 may be stored in and supported by the boot 225 within the housing 205.

The fluid hose 230 is coupled to the nozzle 220 and is fluid communication with one or more fluid storage facilities (e.g., aboveground or underground storage tanks) and provides a closed path for fluid to be pumped from the storage facilities to the nozzle 220. Generally, the fluid hose 230 may be extended from the housing 205 through the retracted hose doors 215 once the nozzle door 210 has been adjusted to the open position. The fluid hose 230 may then be returned to the interior volume 201 of the housing 205 through the hose doors 215 and stored therein.

In some embodiments, the fluid hose 230 may consist of multiple segments of hose connected by, for instance, the coupling 245. The coupling 245 may allow one or more of the segments to be decoupled from the remaining portion of the hose 230 when, for instance, the fluid hose 230 experiences a large tensile force. For example, the customer or user may accidentally leave the nozzle 220 in the vehicle after completion of fluid dispensing and leave the fueling facility. In order to minimize damage to the hose module 200 and the components therein, the portion of the hose 230 between the coupling 245 and nozzle 220 may be automatically decoupled when the tensile force exceeds a threshold value. In some embodiments, the coupling 245 may include one or more valves or other, alternative shut-off devices, such that upon decoupling of the hose 230 at the coupling 245, fluid contained in the hose 230 does not escape the hose 230.

In certain embodiments, a hose pulley 250 helps facilitate extension of the fluid hose 230 from the housing 205. A first, portion of the fluid hose 230 may be freely extendable from the housing 205 while a second portion of the hose 230 coupled to the first, portion may be under a tensile force urging the second portion into the housing 205. For example, the first portion of the hose 230 may be extended by the customer or user and, if necessary, the customer may then pull an additional amount of hose 230 from the housing 205 against the tensile force applied to the second portion of the hose 230. In some embodiments, the tensile force may be applied to the second portion of hose 230 by the hose pulley 250. For instance, one or more bungee cords may be connected between the housing 205 and the hose pulley 250, thereby returning the hose pulley 250 to its original position when the hose, tension, is released, and thus the second portion of hose 230 into the interior volume of the cabinet 201.

The linear solenoid 260, in some embodiments, may be mounted adjacent a lower surface of the boot 225 and, upon activation, extend the plunge pin 240 toward the front of the hose module 200. The solenoid 260 may be activated according to the location of the nozzle 220 relative to the boot 225. For instance, the hoot 225 may include one or more sensors (not shown) that detect, whether the nozzle 220 is positioned in the boot 225. Upon detection of the removal of the nozzle 220 from the boot 225, the sensors may signal (directly or indirectly) the solenoid 260 to activate, thus extending the plunge pin 240 to prevent complete closure of the nozzle door 210 as it descends from the open position to the closed position. As more fully explained with reference to FIGS. 4A-B, such prevention of the complete closure of the nozzle door 210 may prevent complete closure of the hose doors 215. Upon positioning of the nozzle 220 into the boot 225 (e.g., after a fluid dispensing operation has been completed), the sensors may signal the solenoid 260 to deactivate, thereby retracting the plunge pin 240 and allowing the nozzle door 210 to completely close.

More specifically, in some embodiments, the one or more sensors may be a magnetic sensor that upon detection of removal of the nozzle 220 from the boot 225, close a switch to transmit a signal to a controller or microprocessor. For example, the magnetic sensor may close a switch to signal the controller 110 and/or one or more of the processors therein. The controller 110 may then, energize the solenoid 260 to extend the plunge pin 240. Turning to FIG. 3C, in some embodiments, a bracket 502 may be directly coupled to the linear solenoid 260 and extend into the path of the nozzle door 210 upon energizing of the solenoid 260, thereby preventing the nozzle door 210 from fully returning to the closed position. The bracket 502 may be pivoted to its extended position, as shown in this figure, such that an opposing bracket (not shown) mounted at or near the top of the nozzle door 210 (or where appropriate) lands on the bracket 502 as the nozzle door 210 returns to its closed position. More specifically, the bracket 502 may pivot (e.g., rotates clockwise) about a shoulder bolt 506*a* with a second shoulder bolt 506*b* serving as a stop mechanism to the bracket 502 as it pivots about the bolt 506*a*. As illustrated in FIG. 3C, such embodiments may include the solenoid 260 mounted above the nozzle boot 225 rather than below the boot 225. As the door 210 may be prevented from returning to its closed position by the bracket 502, the nozzle door 210 may not engage one or more linkages 265 (shown in FIGS. 4A-B) to thereby close the hose doors 215. The bracket 502, further, may be a spring-loaded bracket with a spring 504. Upon deenergizing of the solenoid 260, the spring 504 retracts the bracket 502 by pivotal motion (e.g., rotates counterclockwise) from the path of the nozzle door 210, allowing the door 210 to return to its closed position.

Alternatively, in some embodiments, the one or more sensors may be a mechanical sensor coupled to the nozzle boot 225. The mechanical sensor may, in some embodiments, be a flapper element located at a top of the boot 225 that pivots when the nozzle 220 is inserted and/or removed from the boot 225. Upon removal of the nozzle 220 from the boot 225, the mechanical flapper may pivot to close the switch to signal the controller 110. As noted above, the controller 110 or processor therein may then energize the solenoid 260 to pivotally extend the bracket 502 and prevent full closure of the nozzle door 210.

Continuing with FIG. 2, the ballast 270 may be coupled to the nozzle door 210 by a ballast cord 280. The ballast cord 280 may be wrapped around the ballast pulley 275, thus allowing the ballast 270 to exert an upward force on the nozzle door 210 that is slightly less than the weight of the door 270. In some embodiments, the ballast 270 may thus act as a counterbalance to the nozzle door 210, thereby retarding, but not fully preventing, the downward movement of the nozzle door 210 from the open to closed position once the consumer releases the door 210. As noted above, in some embodiments, the ballast 270, ballast cord 280, and the ballast pulley 275 may be replaced with a spring-loaded reel and cable connected to nozzle door 210, whereby the tension of the spring-loaded reel is used to control the descent of nozzle door 210.

The air conditioner 285 may be mounted fully within the housing 205 and condition (e.g., heat and/or cool, dehumidify and/or humidify) the interior volume 201 of the hose module 200 by, for example, recirculating air within the volume 201 and through the conditioner 285. In another embodiment, the air conditioner 285 may be mounted to an exterior surface of the housing 205 and provide conditioned (e.g., heated and/or cooled, dehumidified and/or humidified) outside air to the interior volume 201. Further, in some embodiments, the air conditioner 285 may be mounted such that a portion of the conditioner 285 is exposed to the exterior of the housing 205 while a portion of the conditioner 285 is situated within the volume 201. Thus, the air conditioner 285 may mix and/or condition outside air and recirculated air and provide the conditioned air to the interior volume 201. In some embodiments, the air conditioner 285 may include one or more fans, one or more cooling and/or heating coils (e.g., DX, hydraulic, electric, glycol, ammonia), and one or more control devices (e.g., thermostat, fan speed switch). For instance, in some embodiments, the air conditioner 285 may be controlled according to a thermostat located within the interior volume 201 in order to maintain a temperature of the interior volume 201 to a set-point temperature (e.g., substantially above a freezing- or gel-point of fluid dispensed by the nozzle 220). The air conditioned 285, alternatively, may also be mounted within the fluid dispenser 100 and use a fan to circulate the conditioned air throughout 100 and 120.

Figure 3A:
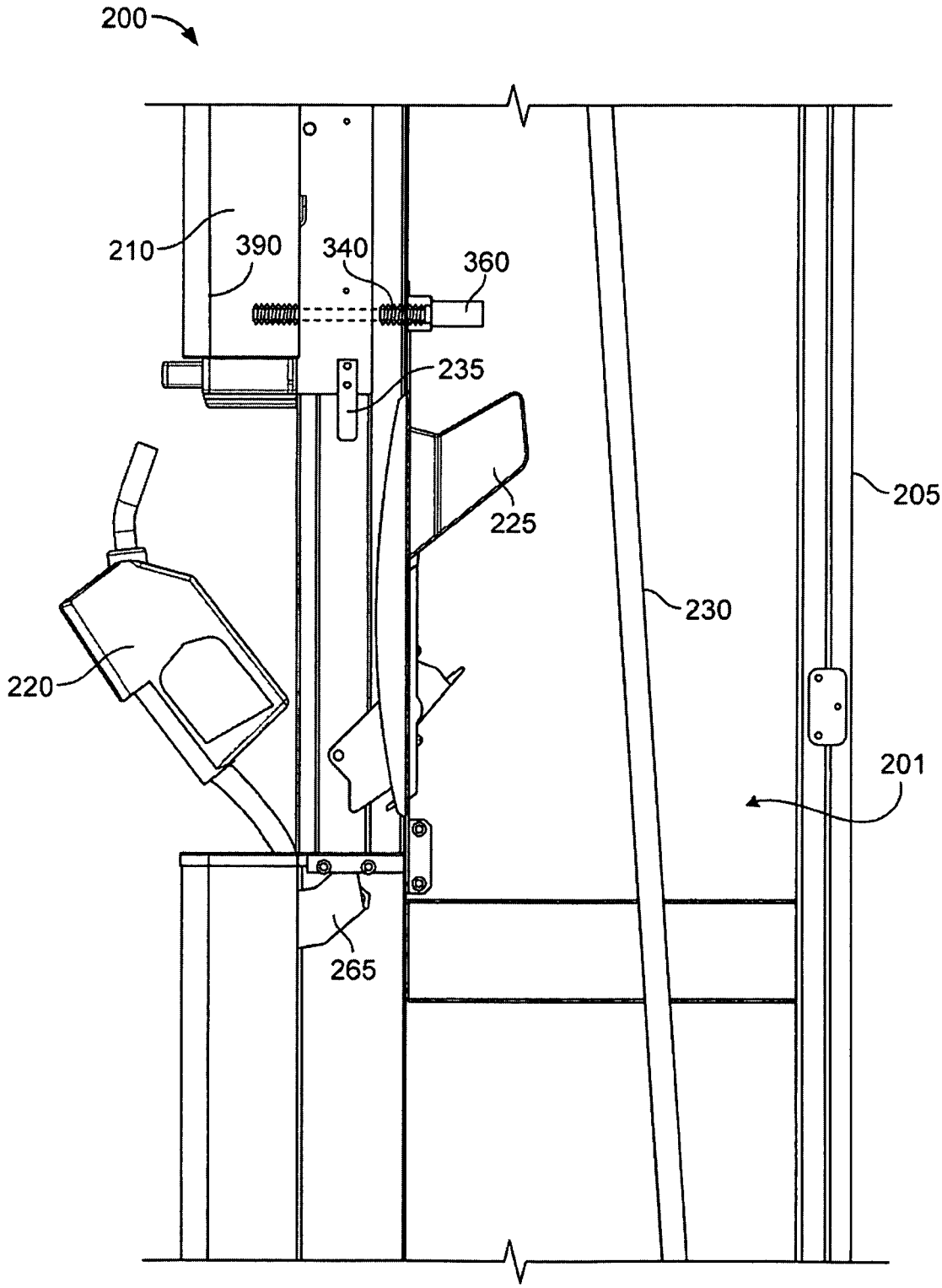
FIG. 3A illustrates a sectional view of one embodiment of one portion of a hose module utilizing one technique to retain a nozzle door of the hose module in an open position according to the present disclosure.

FIG. 3A illustrates a sectional view of a portion of one embodiment of the hose module 200 including a linear solenoid 360 and a plunge pin 340. More specifically. FIG. 3A illustrates one technique to retain the nozzle door 210 of the hose module 200 in the open position utilizing the linear solenoid 360 and plunge pin 340. In some embodiments, the hose module 200 may include the linear solenoid 360 and plunge pin 340 in place of the linear solenoid 260 and plunge pin 240 described above.

Generally, the linear solenoid 360 and plunge pin 340 act cooperatively to help retain the nozzle door 210 in the open position once the consumer has raised the door 210 to access the nozzle 220. As described above, the boot 225 may include one or more sensors communicably coupled to the controller 110, the solenoid 360, or both, that detect whether the nozzle 220 is positioned in the hoot 225. When the nozzle 220 is not positioned in the boot 225 (i.e., during a fluid dispensing operation), the solenoid 360 is energized by the controller 110 and extends the plunge pin 340 to come into contact with a rear surface 390 of the nozzle door 210. The plunge pin 340 thus engages the rear surface 390 and exerts a force on the nozzle door 210 directed substantially perpendicular to the surface 390. In some embodiments, the force exerted by the plunge pin 340 on the nozzle door 210 normal to the rear surface 390 generates a frictional force on the nozzle door 210 directed substantially vertical in the upward direction. Thus, in some embodiments, a sum of this frictional force and the weight of the ballast 270 may be greater than the weight of the nozzle door 210, thereby effectively retaining the nozzle door 210 in the open position during a fluid dispensing operation. Alternatively, in some embodiments, a mechanical sensor or flapper, as described above, may be coupled to the nozzle boot 225 and operate to signal the controller 110 or a processor therein upon removal of the nozzle 220 from the nozzle boot 225.

When the nozzle 220 is replaced into the boot 225, such as when the fluid dispensing operation has been completed, the sensors (mechanical and/or magnetic) may signal the controller 110 or linear solenoid 360 to deenergize, thus retracting the plunge pin 340 and removing the frictional force on the nozzle door 210. For example, upon return of the nozzle 220, the mechanical or magnetic sensor may open the switch, thereby signaling the controller 110 to deenergize the solenoid 360, which retracts the plunge pin 340. As the weight of the door 210 may be greater than the weight of the ballast 270, the nozzle door 210 may automatically return to the closed position.

Figure 3B:
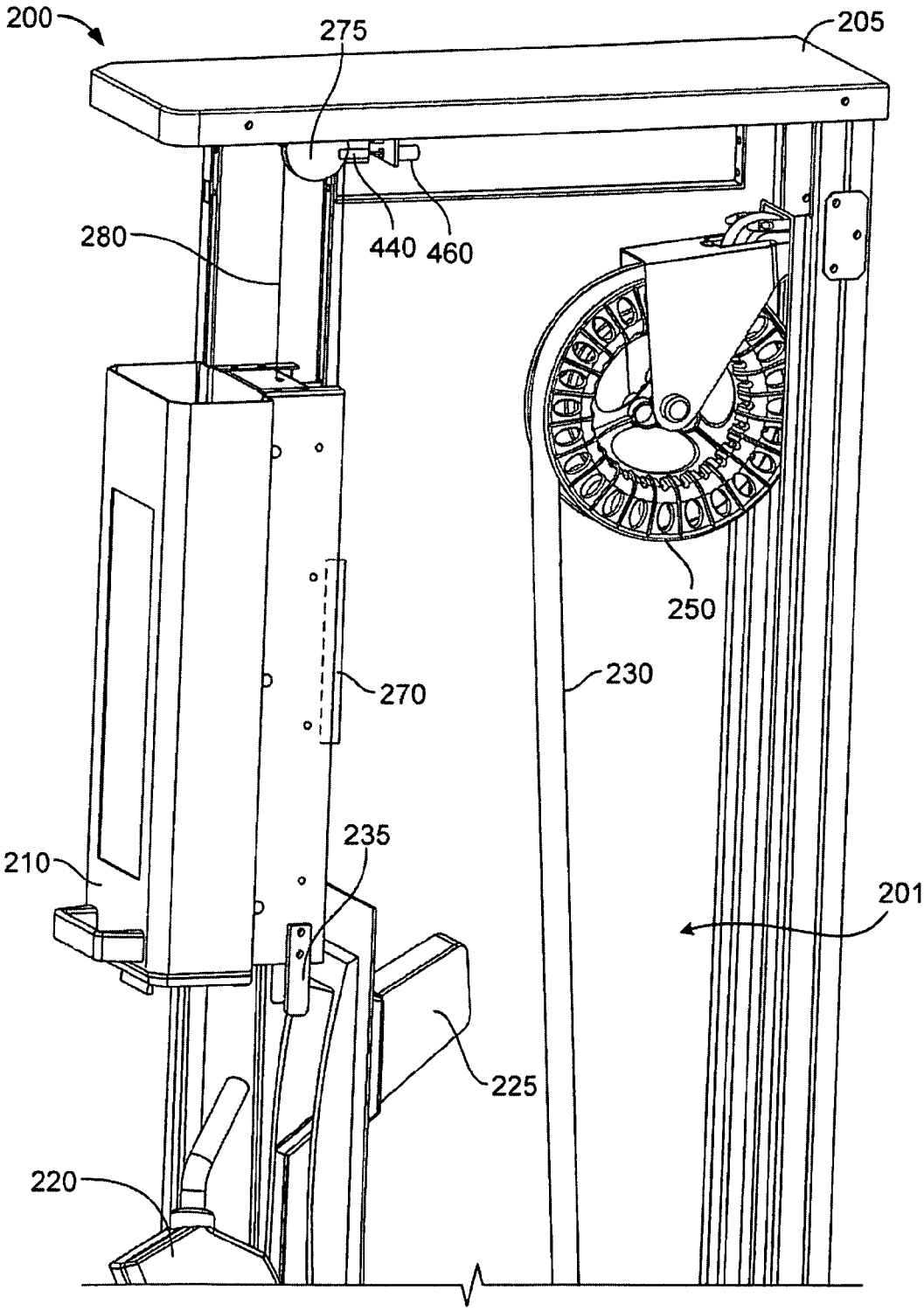
FIG. 3B illustrates a sectional view of one embodiment of one portion of a hose module utilizing another technique to retain a nozzle door of the hose modulo in an open position according to the present disclosure.
Figure 3C:
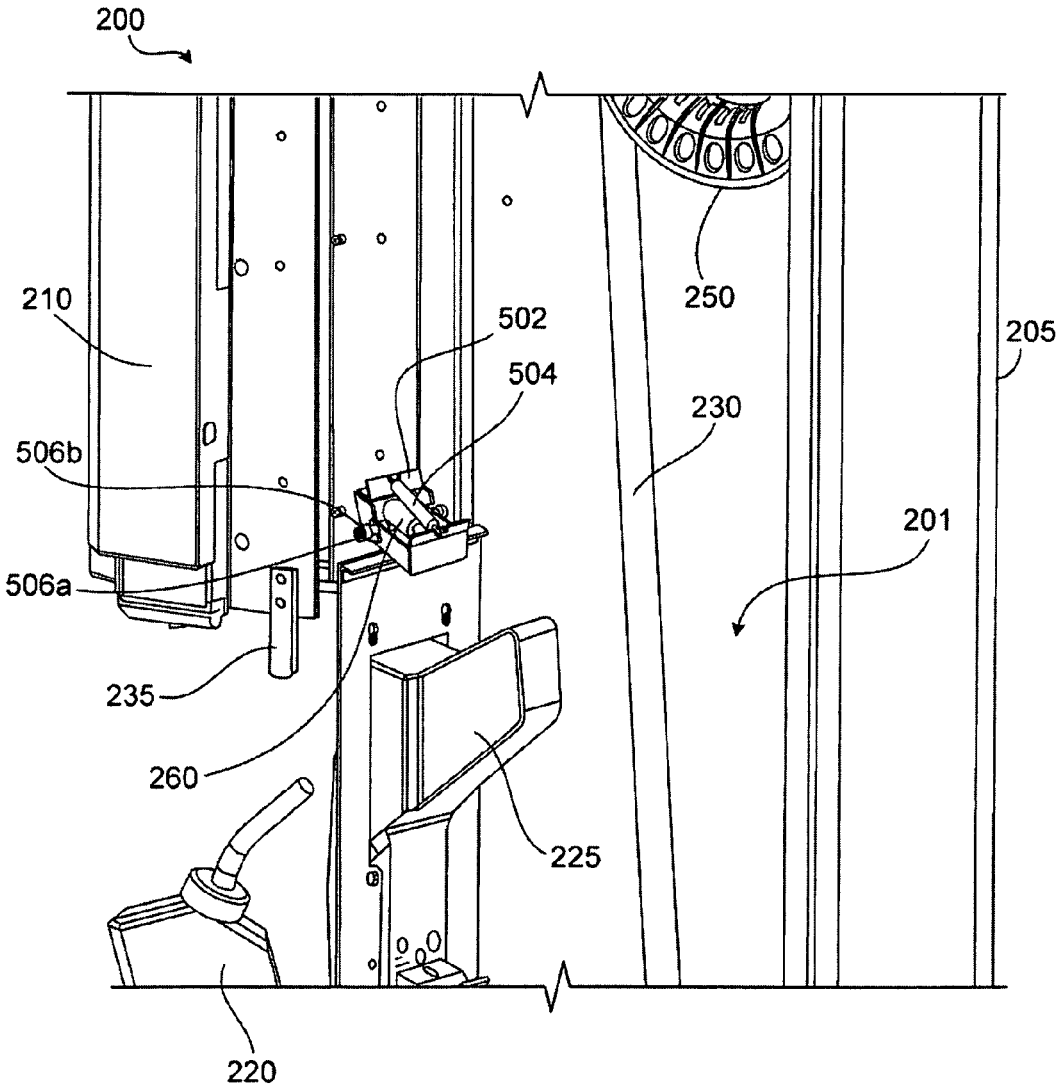
FIG. 3C illustrates a sectional view of one embodiment of one portion of a hose module utilizing a further technique to retain a nozzle door of the hose module in an open position according, to the present disclosure.

FIG. 3B illustrates a sectional view of one embodiment of a portion of the hose module 200 including a linear solenoid 460 and a plunge pin 440. FIG. 3B illustrates another technique to retain the nozzle door 210 of the hose module 200 in the open position utilizing the linear solenoid 460 and plunge pin 440. In some embodiments, the hose module 200 may include the linear solenoid 460 and plunge pin 440 in place of the linear solenoids 260 and 360 and plunge pins 240 and 340 described above.

Generally, the linear solenoid 460 and plunge pin 440 act cooperatively to help retain the nozzle door 210 in the open position once the consumer has raised the door 210 to access the nozzle 220. As described above, the boot 225 may include one or more sensors communicably coupled to the controller 110, the solenoid 360, or both, that detect whether the nozzle 220 is positioned in the boot 225. When the nozzle 220 is not positioned in the boot 225, the controller 110 may energize the solenoid 460 to extend the plunge pin 440 to come into contact with the ballast cord 280 and/or ballast pulley 275. The plunge pin 440, when extended, may thus act as a brake against the ballast cord 280 and/or ballast pulley 275, thereby generating a frictional force against the ballast cord 280 opposing the weight of the nozzle door 210. In some embodiments, a sum of the frictional force exerted by the plunge pin 440 on the ballast cord 280 and the weight of the ballast 270 may be greater than the weight of the nozzle door 210, thereby effectively retaining the nozzle door 210 in the open, position during a fluid dispensing operation.

When the nozzle 220 is replaced, into the boot 225, the sensors may signal the linear solenoid 460 to deenergize, thus retracting the plunge pin 440 and removing the frictional force on the ballast cord 280. As the weight of the door 210 may be greater than the weight of the ballast 270, the nozzle door 210 may automatically return to the closed position. For example, upon return of the nozzle 220, the mechanical or magnetic sensor may open the switch, thereby indicating to the controller 110 to deenergize the solenoid 460, thereby retracting the plunge pin 440 from exerting the frictional force on the ballast cord 280 and/or the ballast pulley 275.

Figure 4A:
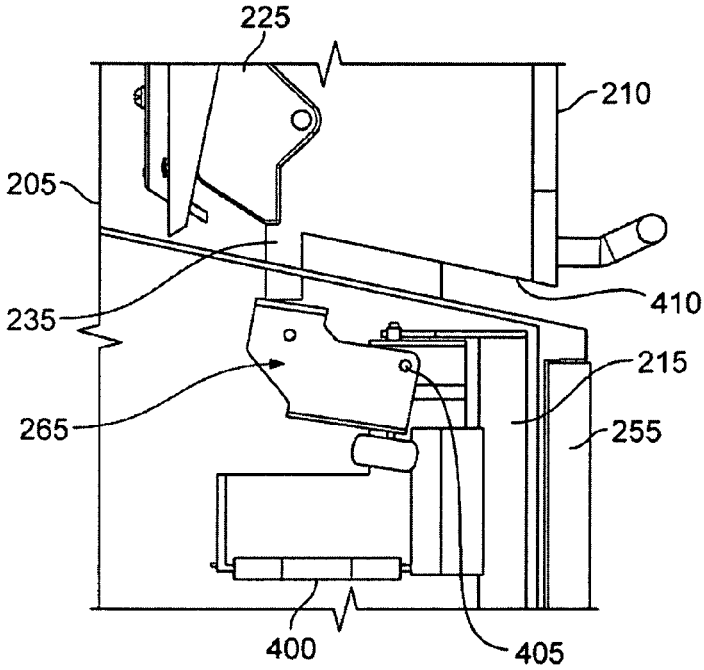
FIG. 4A illustrates a side view of one embodiment of one portion of a hose module in an open position according to the present disclosure.

FIG. 4A illustrates a side view of one embodiment of a portion of the hose module 200 as the nozzle door 210 returns to the closed position from the open position. More specifically. FIG. 4A illustrates the nozzle door 210, plunger 235, one linkage 265, one hose door 215, and a door spring 400 at the moment the plunger 235 of the nozzle door 210 begins to engage the linkage 265. As will be appreciated, FIG. 4A shows only one side of a portion of the hose module 200 and a second plunger 265, linkage 265, door spring 400, and hose door 215 located on an opposed side of the hose module 200 have identical or substantially identical functionality. In some embodiments, however, the module 200 may include a single hose door 215 rather than two opposed doors, in any event, the present disclosure contemplates a single or multiple hose doors, as appropriate.

The door spring 400, generally, is coupled to the linkage 265 and the hose door 215 and urges the hose door 215 into the retracted position. Thus, when the nozzle door 210 is in the open position and the plunger 235 is not engaged (e.g., in contact) with, the linkage 265, the door spring 400 operates to retain the hose door 215 in the retracted position. The linkage 265 is also coupled to the hose door 215 at a pivot 405 and may freely rotate about the pivot 405 as the hose door 215 is adjusted between the retracted position and the shut position.

As the plunger 235 engages the linkage 265, the linkage 265 rotates counterclockwise about the pivot 405, thereby extending the door spring 400 from a compressed state. As the nozzle door 210 is raised to the open position (as shown in FIGS. 3A-B) and the plunger 235 disengages the linkage 265, the linkage 265 rotates clockwise and the door spring 400 returns to its compressed state, thereby opening the hose door 215 to its retracted position.

Figure 4B:
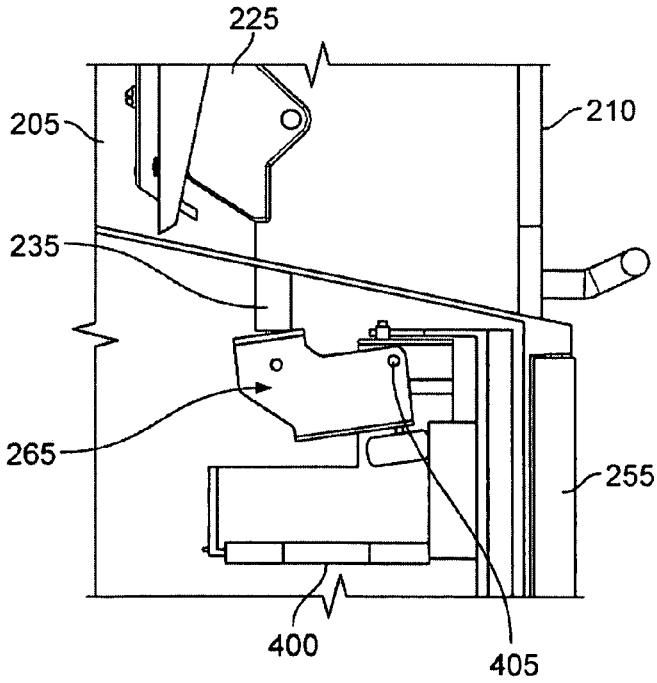
FIG. 4B illustrates a side view of one embodiment of one portion of a hose module in a sealed position according to the present disclosure.

Turning now to FIG. 4B, a side view of one embodiment of a portion of the hose module 200 with the nozzle door 210 in the closed position is shown. Once the nozzle door 210 slides downward to its closed position, the plunger 235 fully engages the linkage 265, thereby extending the door spring 400 and closing the hose door 215. In some embodiments, the weight of the nozzle door 210 is greater than a spring force of the door spring 400; thus the weight of the door 210 may be translated through the linkage 265 to extend the door spring 400 when the plunger 235 engages the linkage 265. Further, due to the greater weight of the nozzle door 210, the door spring 400 remains extended, and thus the hose door 215 remains in the shut position, when the nozzle door 210 is in the closed position.

In some embodiments, one or more flexible gaskets 410 (e.g., neoprene, plastic, nylon, rubber) may be attached to the bottom surface of the nozzle door 210, thereby providing a more effective seal when the door 210 is in the closed position. Alternatively, gaskets may be located on the housing 205 at the interface of the housing 205 and the nozzle door 210. Further, one or more gaskets may be provided on the hose doors 215 or an interface between the housing 205 and the hose doors 215 to more effectively seal the housing 205 when the hose doors 215 are in the shut position.

A number of embodiments of the fluid dispenser including a hose module have been, described, and several, others have been, mentioned or suggested. Other embodiments are within the scope of the disclosure and claims. Some of the advantages of the fluid dispenser have been discussed in the summary of this disclosure. Furthermore, those skilled in the art will, readily recognise additional advantages that a variety of additions, deletions, alterations, and substitutions may be made to these embodiments while still achieving fluid dispensing with a fluid dispenser including a hose module described herein. Thus, the scope of protected subject matter should be judged based on the following claims, which may capture one or more aspects of one or more embodiments.

What is claimed is:

1. A fluid dispenser comprising:

a control module operable to receive at least one command to dispense a fluid and, in response to the command, dispense fluid through a fluid nozzle; and a hose module comprising:

a housing adapted to enclose the fluid nozzle and at least a portion of a fluid hose within an interior volume of the housing, the fluid nozzle supported in a boot when enclosed within the housing;

a first door located adjacent an exterior of the housing and allowing removal of the fluid nozzle from the boot through a first opening created when the first door is adjusted from a closed position to an open position, the first door automatically returning to the closed position from the open position when the fluid nozzle is returned to the boot; and a second door adjacent the exterior of the housing and automatically adjusted from a shut position to a retracted position when the first door is adjusted from the closed position to the open position, the second door allowing access to the fluid hose in the retracted position and automatically returning to the shut position from the retracted position when the first door returns to the closed position.

2. The fluid dispenser of claim 1, the hose module further comprising a third door adjacent the exterior of the housing and adjacent the second door, the third door automatically adjusted from a shut position to a retracted position when the first door is adjusted from the closed position to the open position, the third door allowing access to the fluid hose in the retracted position and automatically returning to the shut position from the retracted position when the first door returns to the closed position.

3. The fluid dispenser of claim 2, wherein at least one of the first, second, and third doors comprise a portion of the exterior of the housing.

4. The fluid dispenser of claim 1 further comprising at least one heater mounted within the interior volume of the housing or to the exterior of the housing, the heater adapted to provide thermal energy to the interior volume of the housing.

5. The fluid dispenser of claim 1, the fluid hose comprising a first segment of fluid hose, at least a portion of the first segment freely extendable from a rest position within the interior volume of the housing when the second door is in the retracted position, wherein the fluid hose experiences substantially no tensile force urging the fluid hose to the rest position when the portion of the first segment is extended from the interior volume of the housing.

6. The fluid dispenser of claim 5, the fluid hose further comprising a second segment of fluid hose coupled to the first segment, at least a portion of the second segment extendable from the rest position when the second door is in the retracted position, wherein the fluid hose experiences a tensile force urging the fluid hose to the rest position when the portion of the second segment is extended front the rest position.

7. The fluid dispenser of claim 6, wherein the tensile force automatically retracts the second segment of the fluid hose to the rest position when the fluid nozzle is enclosed within the housing.

8. The fluid dispenser of claim 1, wherein the hose module further comprises a ballast enclosed within the housing and coupled to the first door, the first door having greater weight than the ballast.

9. The fluid dispenser of claim 1, the first door comprising a plunger, the hose module further comprising a linkage coupled to the second door, the linkage comprising a spring having a corresponding spring force urging the second door to the retracted position from the shut position, wherein the plunger is adapted to exert a force on the linkage greater than the spring force as the first door returns to the closed position from the open position, the second door urged from the retracted position to the shut, position as the plunger exerts the force on the linkage.

10. The fluid dispenser of claim 1, the fluid hose adapted to carry a fluid, wherein the fluid comprises an aqueous urea solution.

11. A fluid dispenser hose module comprising:

a housing adapted to enclose a fluid nozzle and at least a portion of a fluid hose within an interior volume of the housing, the fluid nozzle supported in a hoot when enclosed within the housing;

a first door located adjacent an exterior of the housing and allowing removal of the fluid nozzle from the boot through a first opening created when the first door is adjusted from a closed position to an open position, the first door automatically returning to the closed position from the open position when the fluid nozzle is returned to the boot; and a second door adjacent the exterior of the housing and automatically adjusted from a shut position to a retracted position when the first door is adjusted from the closed position to the open position, the second door allowing removal of at least a portion of the fluid hose through a second opening created when the second door is adjusted to the retracted position and automatically returning to the shut position from the retracted position when the first door returns to the closed position.

12. The hose module of claim 11 further comprising a third door adjacent the exterior of the housing and adjacent the second door, the third door automatically adjusted from a shut position to a retracted position when the first door is adjusted from the closed position to the open position, the third door allowing removal of at least a portion of the fluid hose through a third opening adjacent the second opening when the third door is adjusted to the retracted position and automatically returning to the shut position from the retracted position when the first door returns to the closed position.

13. The hose module of claim 12, wherein the second door and the third door are automatically adjusted from their corresponding shut positions to their corresponding retracted positions substantially simultaneously when the first door is adjusted from the closed position to the open position, the second door and the third door automatically adjusted from their corresponding retracted positions to their corresponding shut positions substantially simultaneously when the first door returns to the closed position.

14. The hose module of claim 11 further comprising at least one heater mounted within the interior volume of the housing or to the exterior of the housing, the heater adapted to provide thermal energy to the interior volume of the housing.

15. The hose module of claim 11, the fluid hose comprising a first segment of fluid hose, at least a portion of the first segment freely extendable from a rest position within the interior volume of the housing when the second door is in the retracted position, wherein the fluid hose experiences substantially no tensile force urging the fluid hose to the rest position when the portion of the first segment is extended from the interior volume of the housing.

16. The hose module of claim 15, the fluid hose further comprising a second segment of fluid hose coupled to the first segment, at least a portion of the second segment extendable from the rest position when the second door is in the retracted position, wherein the fluid hose experiences a tensile force urging the fluid hose to the rest position when the portion of the second segment is extended from the rest position.

17. The hose module of claim 16, wherein the tensile force automatically retracts the second segment of the fluid hose to the rest position when the fluid nozzle is enclosed within the housing.

18. The hose module of claim 11 further comprising a ballast enclosed within the housing and coupled to the first door, the ballast exerting a ballast force on the first door corresponding to a weight of the ballast, the first door having greater weight than the ballast.

19. The hose module of claim 18 further comprising a plunge pin adapted to exert a force on at least one of the first door and the ballast when the fluid nozzle is removed from the boot, a sum of the force and the ballast force greater than the weight of the first door.

20. The hose module of claim 11 further comprising a blocking member adapted to prevent the first door from returning to the closed position from the open position when the fluid nozzle is removed from the boot and allow the first door to return to the closed position from the open position upon return of the fluid nozzle to the boot.

21. The hose module of claim 11, the first door comprising a plunger, the module further comprising a linkage coupled to the second door, the linkage comprising a spring having a corresponding spring force urging the second door to the retracted position from the shut position, wherein the plunger is adapted to exert a force on the linkage greater than, the spring force as the first door returns to the closed position from the open position, the second door urged from the retracted position to the shut position as the plunger exerts the force on the linkage.

22. The hose module of claim 11, the fluid hose adapted to carry a fluid, wherein the fluid comprises an aqueous urea solution.

23. A method for dispensing fluid comprising:

providing a fluid dispenser, the fluid dispenser comprising:

a control module; and a hose module comprising:

a housing adapted to enclose the fluid nozzle and at least a portion of a fluid hose within an interior volume of the housing, the fluid nozzle supported in a boot when enclosed within the housing;

a first door located adjacent an exterior of the housing, the first door automatically returning to the closed position from the open position when the fluid nozzle is returned to the boot; and a second door located adjacent the exterior of the housing and automatically adjusted from a shut position to a retracted position when the first door is adjusted from the closed position to the open position, the second door allowing access to the fluid hose in the retracted position and automatically returning to the shut position from the retracted position when the first door returns to the closed position;

receiving a command at the control module to commence fluid dispensing;

adjusting the first door from the closed position to the open position to create an opening allowing access to the fluid nozzle within the interior volume of the housing;

removing the fluid nozzle from the boot through the opening;

dispensing fluid from the fluid nozzle; and returning the fluid nozzle to the boot.

* * * * *